US006776000B2

(12) United States Patent
Kim et al.

(10) Patent No.: US 6,776,000 B2
(45) Date of Patent: Aug. 17, 2004

(54) BUILT-IN REFRIGERATOR

(75) Inventors: Kyung Sik Kim, Inchon-kwangyokshi (KR); Tae Hee Lee, Seoul (KR); Yang Gyu Kim, Seoul (KR); Eui Yeop Chung, Taegu-kwangyokshi (KR); Se Young Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/370,485

(22) Filed: Feb. 24, 2003

(65) Prior Publication Data

US 2004/0003618 A1 Jan. 8, 2004

(30) Foreign Application Priority Data

Jul. 2, 2002 (KR) ..... P2002-38025
Jul. 5, 2002 (KR) ..... P10-2002-0038864
Dec. 10, 2002 (KR) ..... P10-2002-0078410

(51) Int. Cl.[7] ..... F25D 23/12
(52) U.S. Cl. ..... 62/258; 62/259.1
(58) Field of Search ..... 62/259.1, 258, 62/314, 428, 507, 508

(56) References Cited

U.S. PATENT DOCUMENTS 2,708,350 A 5/1955 Earle
3,462,966 A 8/1969 Reid et al.
3,627,396 A * 12/1971 Miller ..... 312/49
3,650,122 A 3/1972 Lieberman
3,651,660 A 3/1972 Quiros
3,926,486 A * 12/1975 Sasnett ..... 312/198
3,971,605 A * 7/1976 Sasnett ..... 312/198
3,983,583 A * 10/1976 Herman et al. ..... 62/331
4,221,441 A * 9/1980 Bain ..... 312/228
4,424,686 A 1/1984 Lapeyre et al.
4,723,631 A 2/1988 Tremblay
4,907,419 A 3/1990 Kruck et al.
5,152,689 A * 10/1992 Kurzman ..... 434/79
5,157,940 A * 10/1992 Bertu et al. ..... 62/382
5,368,486 A * 11/1994 Kurzman ..... 434/79
5,918,474 A 7/1999 Khanpara et al.
6,282,914 B1 9/2001 Steinhoff et al.
6,532,757 B2 3/2003 Holzer et al.
2003/0005716 A1 1/2003 Doran
2003/0029178 A1 2/2003 Zenter et al.

FOREIGN PATENT DOCUMENTS

JP 401193580 A * 8/1989
JP 401193581 A * 8/1989
JP 404319310 11/1992
JP 408117038 A * 5/1996
JP 409173164 A * 7/1997
JP 409313269 A * 12/1997
JP 409313270 A * 12/1997

* cited by examiner

*Primary Examiner*—William E. Tapolcai
*Assistant Examiner*—Mohammad M. Ali
(74) *Attorney, Agent, or Firm*—Fleshner & Kim, LLP

(57) ABSTRACT

A built-in refrigerator is disclosed, which includes a cabinet provided in a sink and having a door at a front side thereof and a component chamber at a rear bottom thereof; a molding provided on a floor located at a front bottom of the cabinet; a compressor provided in the component chamber; a cooling fan provided in the component chamber for blowing air to the compressor; a condenser condensing a flowing refrigerant by heat-exchange with the air blown from the cooling fan; and a ventilating passage connecting the component chamber to the outside of the molding for ventilating the component chamber. Also, the built-in refrigerator further includes a dividing strip for dividing the ventilating passage into an inflow passage through which the air is introduced, and an outflow passage through which the air is discharged, wherein the dividing strip is inclined at a predetermined angle θ so as to form an inlet of the inflow passage larger than an outlet of the inflow passage. The condenser may be provided on an inner sidewall of the component chamber.

23 Claims, 6 Drawing Sheets

BUILT-IN REFRIGERATOR

This application claims the benefit of the Korean Application No. P2002-38025 filed on Jul. 2, 2002, P2002-38864 filed on Jul. 5, 2002, and P2002-78410 filed on Dec. 10, 2002, which are hereby incorporated by reference.

BACKGROUND OF THE INVENTION

1. Field of the Invention

The present invention relates to a refrigerator.

2. Discussion of the Related Art

In general, a refrigerator is an apparatus for taking storage of foods freshly for a long-term period, and is divided into a cabinet with a freezer or a refrigerator chamber for taking storage of foods in frozen or cold storage states, and component chamber, and a refrigerating cycle for cooling the freezer or the refrigerator chamber. Herein, main components of the refrigerating cycle are a compressor, a condenser, an evaporator and an expansion valve. Generally, the compressor and the condenser are provided in a component chamber equipped at the rear bottom of the cabinet, and the evaporator and the expansion valve are provided adjacent to the freezer or the refrigerator chamber. The freezer or the refrigerator chamber of the cabinet is cooled through the following sequence.

First, the compressor is driven by an electromotor to compress refrigerant in gas state, and then to send the compressed refrigerant to the condenser. Also, air is sent to a cooling fan so as to liquefy the refrigerant in the condenser. The flow rate of the refrigerant in liquid state is adjusted at the expansion valve and thus the refrigerant rapidly expands and is evaporated with being injected into the evaporator. At this time, the refrigerant absorbs heat from the periphery of the evaporator to thereby cool the freezer and the refrigerator chamber. The refrigerant in gas state returns to the compressor, and again repeats the aforementioned condensation, expansion, evaporation, and compression cycles.

Meanwhile, since the above-constituted refrigerator is generally provided at one sidewall of kitchen or living room, it is protruded by its size from the wall to badly affect on beauty on appearance, and there is also caused a drawback in that practical space use is lowered. To this end, in these days, there is being requested the development of a built-in refrigerator which one part of a body thereof enters into the wall in or can be provided at the sink. Among these built-in refrigerators, there is being more strongly requested the built-in refrigerator which is provided at the sink which provides a convenience of use upon cooking of foods and is the most preferred space by housewives. In case a refrigerator is provided in a sink, the air flow is blocked owing to the characteristic of the built-in refrigerator, so that there is focused a ventilation technology for effectively ventilating the heat generated from the condenser and the compressor provided in the component chamber provided at the rear bottom of the cabinet.

SUMMARY OF THE INVENTION

Accordingly, the present invention is directed to a built-in refrigerator that substantially obviates one or more problems due to limitations and disadvantages of the related art.

An object of the present invention is to provide a built-in refrigerator, which can be provided at a sink to enhance practical space use of a kitchen or a living room and to enhance the beauty on appearance.

Another object of the present invention is to provide a built-in refrigerator, which can effectively radiate heat from a condenser and a compressor.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a built-in refrigerator includes a cabinet provided in a sink and having a door at a front side thereof and a component chamber at a rear bottom thereof; a molding provided on a floor located at a front bottom of the cabinet; a compressor provided in the component chamber; a cooling fan provided in the component chamber for blowing air to the compressor; a condenser condensing a flowing refrigerant by heat-exchange with the air blown from the cooling fan; and a ventilating passage connecting the component chamber to the outside of the molding for ventilating the component chamber.

The condenser may be provided in the component chamber, or on a wall of the component chamber. In case of that the condenser is provided on the wall of the component chamber, the condenser is partially buried in the wall for being fixed thereto, and is partially exposed for the heat-exchange with the air blown from the cooling fan.

A plurality of holes may be provided on both sidewalls of the component chamber.

The ventilating passage includes a first passage provided by maintaining a predetermined space between an upper side of the molding and a lower side of the cabinet, and a second passage provided by maintaining a predetermined space between a lower side of the cabinet and the floor.

The lower side of the cabinet is provided such that the door side thereof is higher than the component chamber side thereof, to thereby form the ventilating passage having a bent portion.

A rib having an air-guiding surface is provided at an external corner in the bent portion of the ventilating passage, the air-guiding surface reducing flow resistance of air. The rib includes a first rib provided at a contact portion of an inner sidewall of the molding and the floor, and a second rib provided at a contact portion between the side of the cabinet facing the upper side of the molding and the bent portion of the cabinet facing the inner side of the molding. At this time, the air-guiding surface is formed as a straight line having an inclined angle, or as a bent line having a predetermined angle, in which the bent line of the air-guiding surface is concave.

The built-in refrigerator according to the present invention further includes a dividing strip for dividing the ventilating passage into an inflow passage through which the air is introduced, and an outflow passage through which the air is discharged. At this time, the dividing strip is provided for forming the inflow passage at an sucking side of the cooling fan, and for forming the outflow passage at a discharging side of the cooling fan. Preferably, the dividing strip is inclined about 20°(θ) to an imaginary perpendicular line for maintaining same width to the inlet and outlet of the inflow passage.

The molding is provided on the floor between the door and a protruding portion of the lower side of the cabinet. At this time, the lower side of the door may be positioned at the same height as the upper side of the molding, or may be positioned at a height below the upper side of the molding.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

A built-in refrigerator according to the present invention will be explained with reference to the accompanying drawings.

Figure 1:
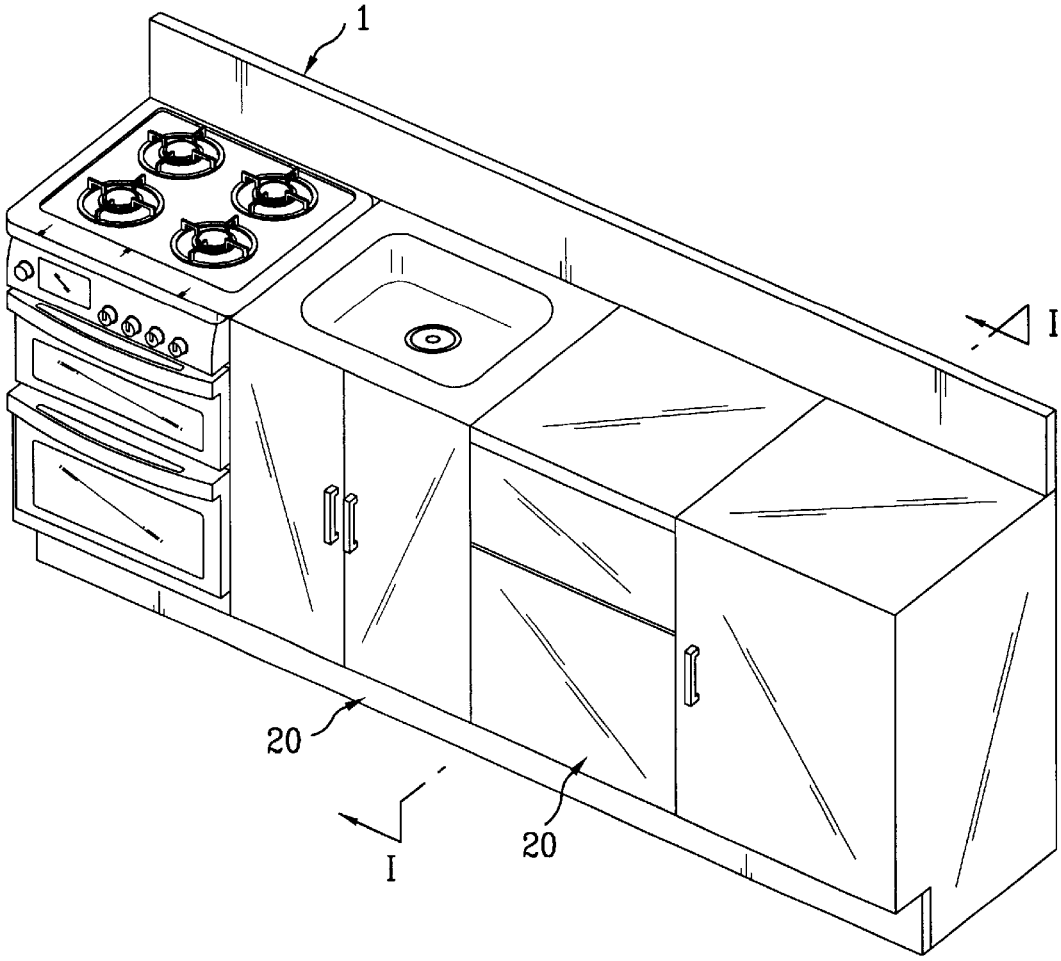
FIG. 1 is a perspective view of a built-in refrigerator provided in a sink according to one embodiment of the present invention.

The built-in refrigerator according to the present invention includes a cabinet 10, a component chamber 11, a door 12 and a molding 20. At this time, the cabinet 10 is provided in a sink 1. Then, the door 12 is provided at the front of the cabinet 10, and the component chamber 11 is formed at the rear bottom of the cabinet 10. The molding 20 is provided on the floor located at the low portion of the front side of the cabinet 10. In the built-in refrigerator according to the present invention, it is necessary to provide the molding 20 due to the following reasons. Referring to FIG. 1, the molding 20 is selected as one of the elements of the refrigerator so as to shield a complicated space located at the lower portion of the sink 1 considering its appearance, which is a peculiar role of the molding 20, and to prevent peripheral garbage during its cleaning from being introduced into the lower space of the sink 1. The detailed location and height of the molding 20 will be explained later.

A compressor 40 is provided in the component chamber 11, and the compressor 40 compresses refrigerant in gas state and radiates heat by compressing. Also, a cooling fan 50 is provided in the component chamber 11 for cooling the compressor 40 by ventilating the compressor 40. Then, the refrigerant of the gas state compressed in the compressor 40 flows into the condensers 30 and 130. Thus, in the condensers 30 and 130, the refrigerant makes a heat-exchange with the air from the cooling fan 50.

Two types of condensers according to representative embodiments of the present invention will be explained as follows.

Figure 2:
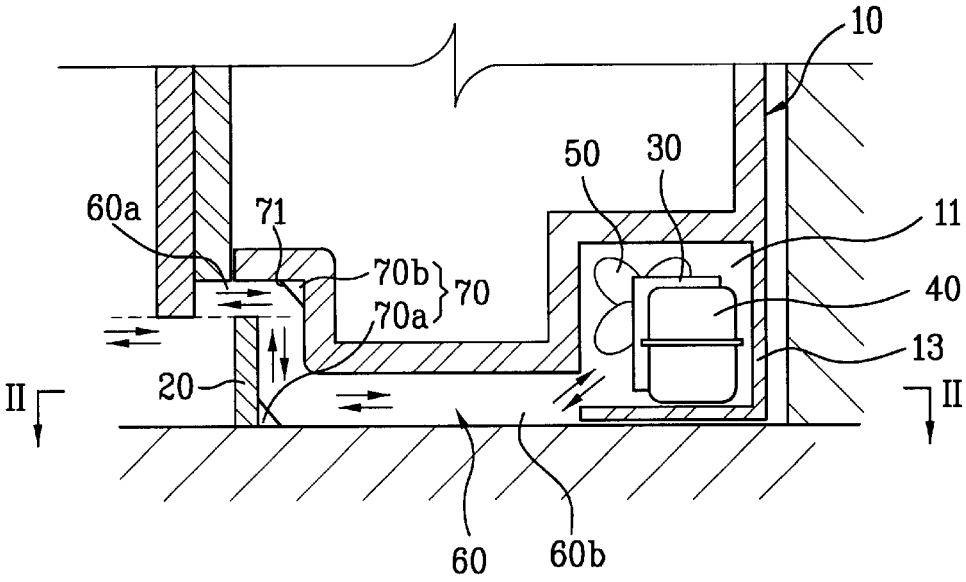
FIG. 2 is a sectional view taken along the line I—I of FIG. 1 according to one embodiment of the present invention.
Figure 3:
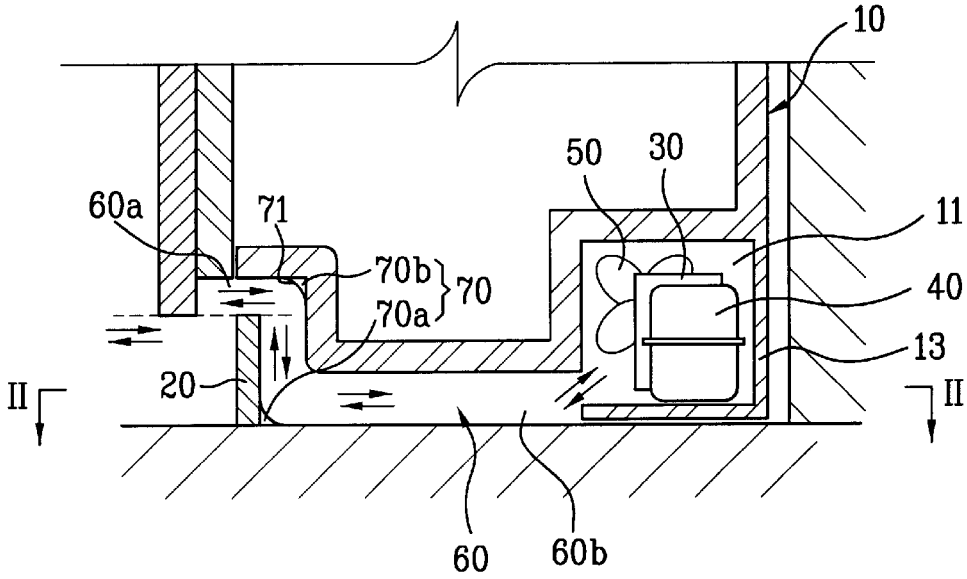
FIG. 3 is a sectional view taken along the line I—I of FIG. 1 according to another embodiment of a rib in the present invention.
Figure 4:
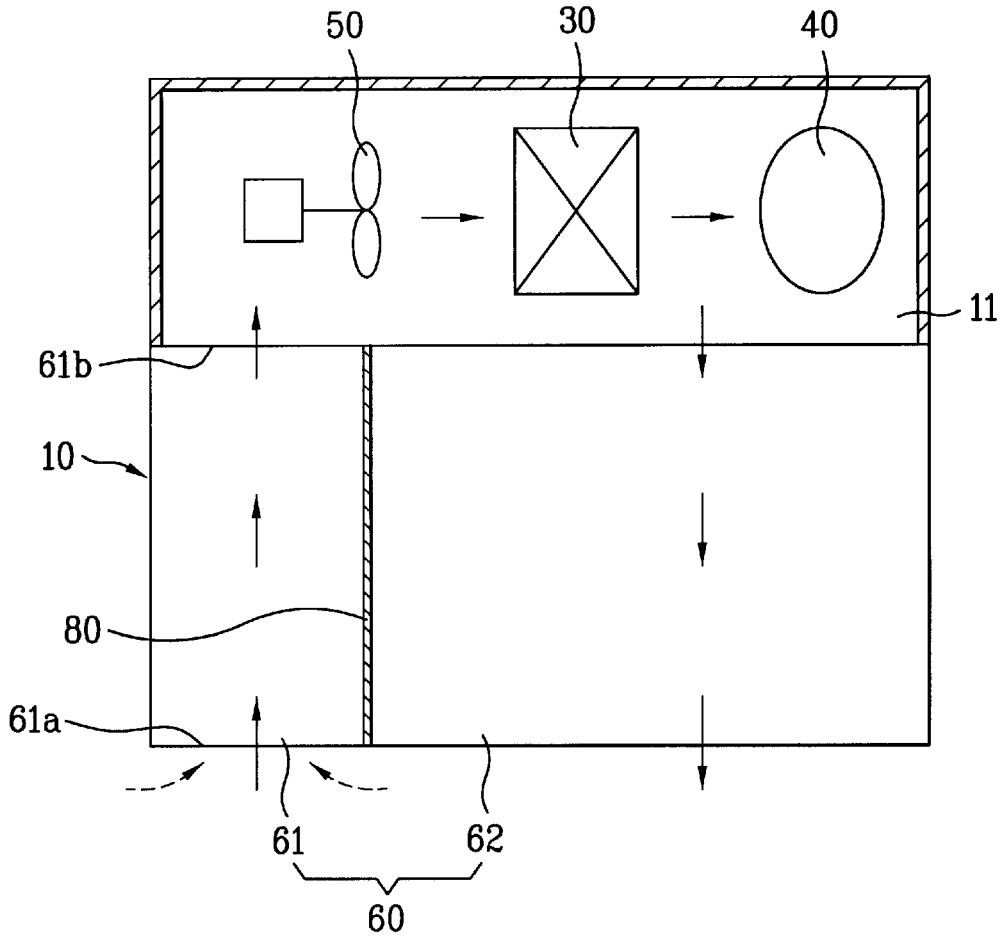
FIG. 4 is a sectional view taken along the line II—II of FIG. 2 and FIG. 3 in a state of removing a molding and a rib.

As shown in FIG. 2 to FIG. 4, a condenser according to one embodiment of the present invention is provided in the component chamber 11 with the compressor 40. The condenser 30 ventilates heat with the air blown from the cooling fan 50 provided at one side of the component chamber 11, thereby condensing the refrigerant flowing in gas state at a high pressure into the refrigerant of liquid state.

Figure 6:
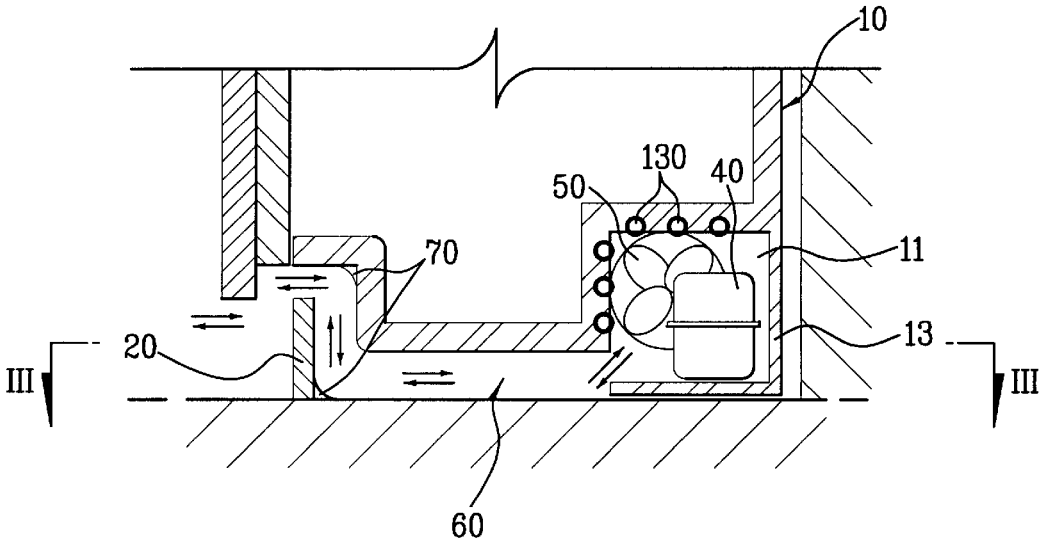
FIG. 6 is a sectional view taken along the line I—I of FIG. 1 according to another embodiment of a condenser in the present invention.

In another embodiment of the present invention, a condenser according to another embodiment of the present invention is provided on wall of the component chamber 11. For example, the condenser 130 shown in FIG. 6 is provided on wall of front and upper sides in a 'S' shape which is suitable for heat exchange due to a wide exchange area. The condenser 130 is partially buried in the wall, and fixed thereto, and the condenser 130 is partially exposed for exchanging the heat for the air from the cooling fan 50. Although not shown, the condenser 130 may be fixed to the wall of the component chamber 11 as a clamp instead of being buried in the wall of the component chamber 11.

If the condenser 130 is installed in a method shown in FIG. 6, a size of the component chamber 11 becomes smaller than that of the related art, thereby enhancing efficiency in using the space of refrigerator. Also, the air from the cooling fan 50 is not provided to the front side of the condenser 130, so that it is possible to decrease flow resistance of the air, thereby improving efficiency in freezing by enhancing air ventilation and heat radiation.

Figure 7:
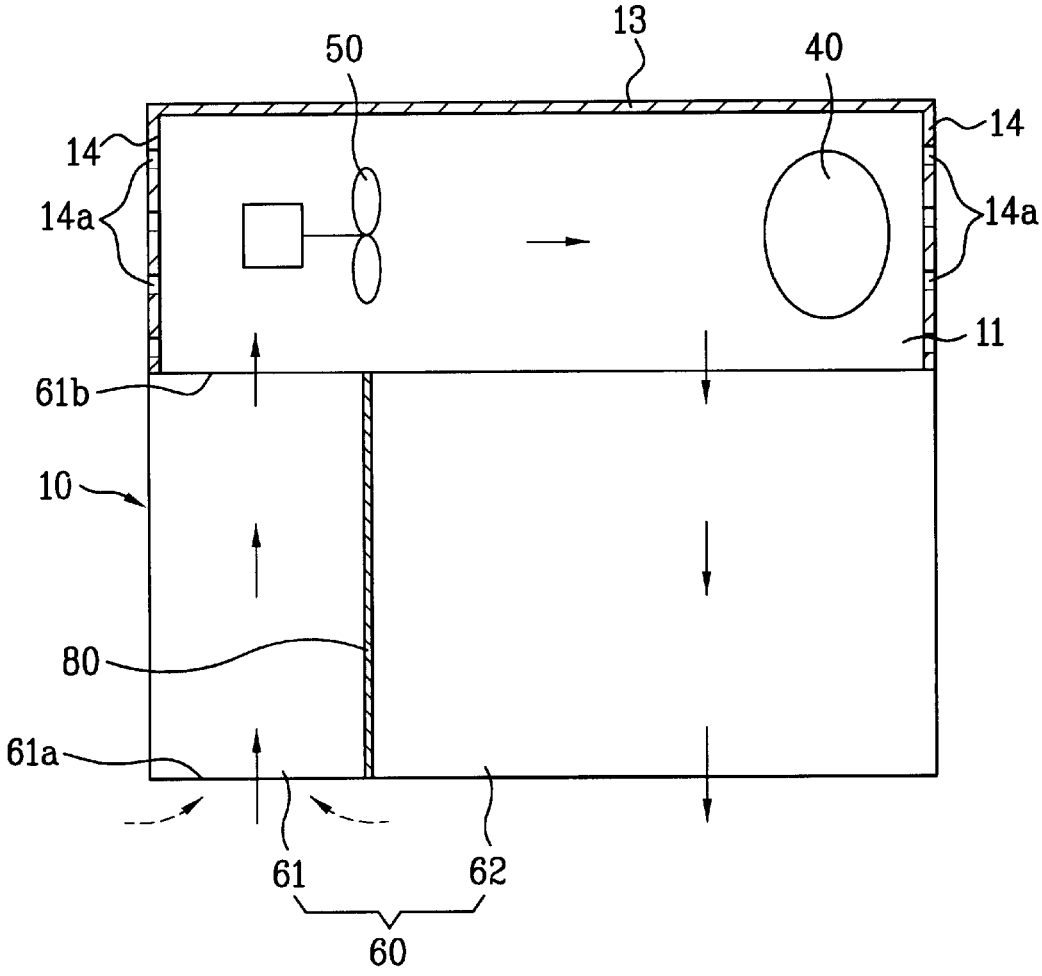
FIG. 7 is a sectional view taken along the line III—III of FIG. 6 in a state of removing a molding and a rib.

As shown in FIG. 7, a plurality of holes 14*a* are provided on the sidewall 14 of the component chamber 11 so as to improve efficiency in the air ventilation and heat radiation. Accordingly, air can flow into and out through the plurality of holes 14*a*, so that the air being provided to the condenser 30 and 130 increases, thereby improving freezing efficiency of the refrigerator with enhancement of efficiency in the condenser 30 and 130.

For example, as shown in FIG. 2 and FIG. 3, a ventilating passage 60 is provided for connecting the front side of the component chamber 11 to the exterior of the molding 20. Referring to FIG. 2, the ventilating passage 60 is provided with a first passage 60*a* and a second passage 60*b*. At this time, a predetermined space is maintained between the upper side of the molding 20 and the lower side of the cabinet 10 for providing the first passage 60*a*. Also, a predetermined space is maintained between the lower side of the cabinet 10 and the floor so as to provide the second passage 60*b*.

The molding 20 forming the first passage 60*a* with the lower side of the cabinet 10 is provided on the floor between the door 12 and a protruding portion of the lower side of the cabinet 10. As shown in FIG. 2, the lower side of the door 12 is positioned at the same height as the upper side of the molding 20. Although not shown, the lower side of the door 12 may be positioned at a height below the upper side of the molding 20. At this time, the door 12 and the molding 20 are provided in the aforementioned structure so as to prevent the first passage 60*a* from being exposed between the upper side of the molding 20 and the lower side of the cabinet 10, thereby enhancing appearance beauty of the refrigerator. In the present invention, the ventilating passage 60 has a bent portion. For this, as shown in FIG. 2 of the present invention, the lower side of the cabinet 10 has different heights including the protruding portion. That is, the lower side of the cabinet 10 at the side of the door 12 is higher than that at the side of the component chamber 11.

Also, a rib 70 having an air guiding surface 71 is provided at an external corner in the bent portion of the ventilating passage 60, the air guiding surface 71 reducing the flow resistance of air. More specifically, as shown in FIG. 2, the rib 70 includes a first rib 70*a* and a second rib 70*b*. The first rib 70*a* is provided at a contact portion of an inner sidewall of the molding 20 and the floor, and the second rib 70*b* is provided at a contact portion between the side of the cabinet 10 facing the upper side of the molding 20 and the bent portion of the cabinet 10 facing the inner side of the molding 20.

The rib 70 of the present invention may be formed in various shapes. However, representative shapes of the rib are shown in FIG. 2 and FIG. 3 according to the present invention. Referring to FIG. 2, the rib 70 of the present invention is formed in a straight line. Meanwhile, the rib 70 shown in FIG. 3 includes the air guiding surface 71 of the bent line having the concave surface.

Referring to FIG. 4, the present invention further includes a dividing strip 80 in the ventilating passage 60. At this time, the dividing strip 80 has a role dividing the ventilating passage 60 into an inflow passage 61 for an air inflow and an outflow passage 62 for an air outflow. In the dividing strip 80 shown in FIG. 4, the inflow passage 61 is provided at an sucking side of the cooling fan 50, and the outflow passage 62 is provided at a discharging side of the cooling fan 50. According to the aforementioned structure of the dividing strip 80, the air being introduced by the inflow passage 61 flows into the suckng side of the cooling fan 50, and then is discharged to the discharging side of the cooling fan 50, so that the air smoothly flows out trough the outflow passage 62.

The dividing strip 80 is provided in the ventilating passage 60, so that cool external air is introduced through the inflow passage 61 when driving the cooling fan 50. Then, the condenser 30 and the compressor 40 heat-exchange with the cool external air, and the air being hot during the aforementioned process is discharged to the outside of the cabinet 10 through the ventilating passage 60. At this time, as shown in FIG. 4, if inlet and output of the inflow passage 61 have the same width, a sectional area of the inflow passage 61 becomes smaller than that of the outflow passage 62. In more detail, the cooling fan 50 is provided not at the center portion but at one side of the component chamber 11, so that the cooling fan 50 blows the air to the condenser 30 and the compressor 40. Accordingly, the dividing strip 80 is provided at one side of the component chamber 11 for being corresponding to the location of the cooling fan 50 in that the dividing strip 80 is provided between the sucking and discharging sides of the cooling fan 50. That is, a sectional area of the outflow passage 62 is larger than that of the inflow passage 61.

If the sectional area of the inflow passage 61 is smaller that that of the outflow passage 62, the air being introduced through the inflow passage 61 decreases. Also, the air has to be turned for being flown into the inlet of the inflow passage 61 at portions of dotted arrows shown in FIG. 4, thereby increasing the flow resistance of air. Thus, the air being introduced to the inflow passage 61 decreases. In a case of that the dividing strip 80 is installed to have the same widths in the inlet and outlet of the inflow passage 61, the efficiency in cooling the compressor 40 and the condenser 30, and in freezing the refrigerator is deteriorated.

Figure 5:
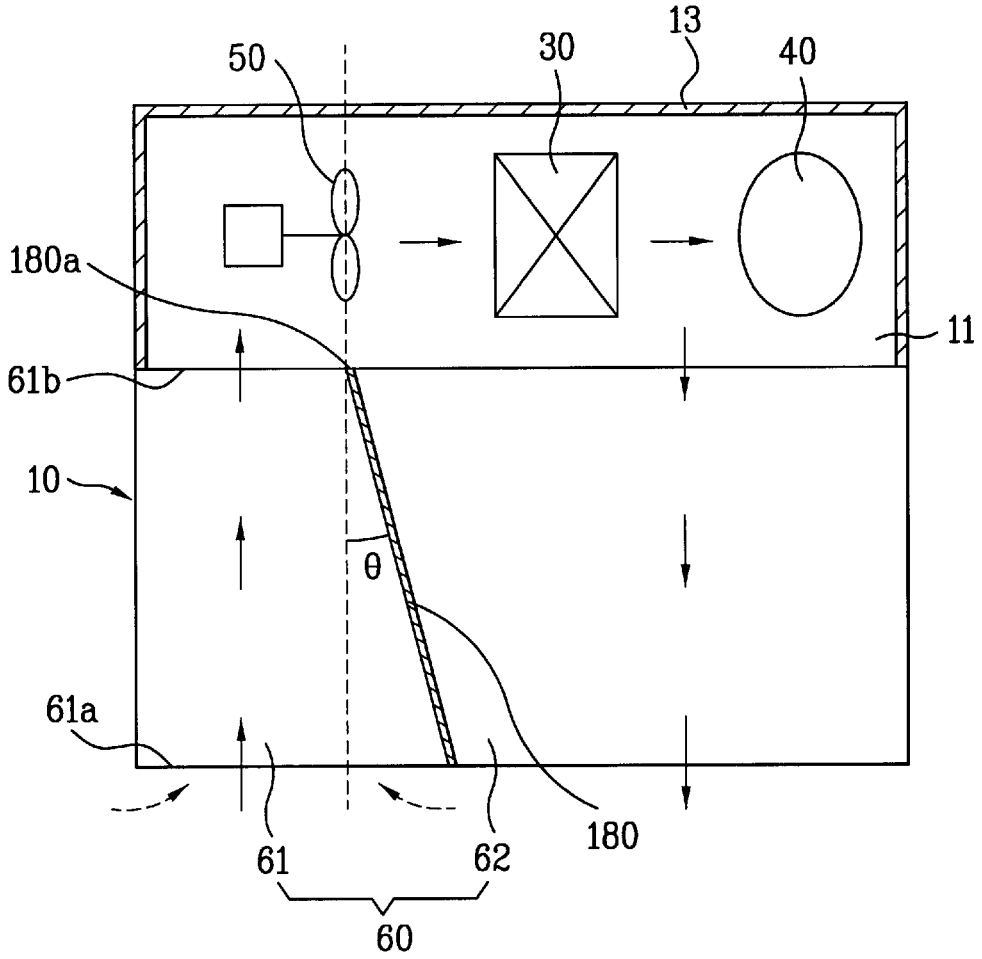
FIG. 5 is a sectional view taken along the line II—II of FIG. 2 and FIG. 3 in a state of removing a molding and a rib according to another embodiment of a dividing strip in the present invention.

To overcome the aforementioned problem, another embodiment of the present invention is proposed, in which a dividing strip 180 is provided in an inclined state, as sown in FIG. 5. That is, the dividing strip 180 is inclined at a predetermined angle θ, so that the inlet of the inflow passage 61 is larger than the outlet of the inflow passage 61. At this time, one end of the dividing strip 180 positioned at the inlet of the inflow passage 61 is provided at the center portion between the sucking and discharging sides of the cooling fan 50. Thus, the sectional area of the inflow passage 61 increases, and flow resistance decreases at the inlet side of the inflow passage 61, thereby sending greater air to the condenser 30 and the compressor 40 as compared to the related art. Accordingly, the freezing efficiency of the refrigerator is improved with improvement of efficiency in cooling the condenser 30 and 130. In this respect, in the embodiment of the present invention, the dividing strip is inclined about 20°(θ) to an imaginary perpendicular line for maintaining same width in the inlet and outlet of the inflow passage 61, thereby improving airflow at maximum 7%.

Meanwhile, a rear wall of the component chamber 11 has no hole so as to smoothly guide the air flowing by rotation of the cooling fan 50 without any influence from the flow resistance of air. Therefore, it is possible to minimize the resistance in the airflow passage with the aforementioned rib 70, thereby obtaining reliability of a product by enhancing the airflow and increasing radiate heat effectively.

The airflow during radiating the heat in the built-in refrigerator according to the present invention will be explained in detail.

First, if the cooling fan 50 provided in the component chamber 11 is driven, the cool external air is introduced into the component chamber 11 through the inflow passage 61. At this time, as shown in FIG. 5, the dividing strip 180 is formed to set the inlet of the inflow passage 61 larger than the outlet of the inflow passage, the flow resistance of the air being introduced through the inflow passage 61 decreases. Since the sectional area of the inflow passage 61 increases, the air is introduced to the component chamber 11 in great quantity.

Referring to FIG. 7, in case of that the plurality of holes 14*a* are provided on the sidewall of the component chamber 11, the cool external air can be introduced to the component chamber 11 through the plurality of holes 14*a* with the inflow passage 61, thereby increasing the air being introduced to the component chamber 11. After that, the cool external air being introduced to the component chamber 11 is discharged by the cooling fan 50, and then is sent to the condenser 30 and 130 and the compressor 40. Sequentially, the condenser 30 and 130 and the compressor 40 heat-exchange with the cool external air, so that the condenser 30 and 130 and the compressor 40 are cooled, and the external air is heated by the heat from the condenser 30 and 130 and the compressor 40.

As shown in FIG. 6, the condenser 130 is provided on the wall of the component chamber 11, so that the air blown from the cooling fan 50 flows at a high speed owing to the decrease of the flow resistance. Accordingly, the greater air passes through the component chamber 11 in a unit time period as compared with that in the related art, thereby improving efficiency in freezing the refrigerator by effectively cooling the component chamber 11.

The hot air, which is heated by the heat being radiated from the condenser 30 and 130 and the compressor 40, is discharged to the outside of the front side of the sink 1 through the outflow passage 62. If the holes 14*a* are provided on the sidewall 14 of the component chamber 11, the hot air is discharged to the outside through the holes 14 with the outflow passage 62. Accordingly, the air is smoothly discharged to the outside in great quantity since the flow resistance of the air being discharged decreases. Meanwhile, the air smoothly flows in the ventilating passage 60 and the component chamber 11 by the rib 70 and the guide of the inflow and outlaw passages 61 and 62, thereby effectively cooling the component chamber 11.

As explained above, the built-in refrigerator according to the present invention has the following advantages.

First, the built-in refrigerator having great heat-radiation efficiency may be provided at the sink to enhance practical space use of a kitchen or a living room and to enhance the beauty on appearance.

Secondly, the molding is provided so as to prevent the outflow passage from being exposed to the outside, and to prevent peripheral garbage during its cleaning from being introduced into the lower space of the sink, which is necessary to sanitation.

Thirdly, the dividing strip and the rib are provided in the outflow passage so as to decrease the flow resistance of air, thereby effectively cooling the component chamber.

Fourthly, the size of the component chamber decreases in that the condenser is provided on the wall of the component chamber, to thereby enhance efficiency in using the inner space of the component chamber and the whole refrigerator.

Fifthly, if the plurality of holes are provided on the sidewall of the component chamber, it is possible to increase the air being introduced and discharged through the plurality of holes so as to effectively cool the component chamber.

Sixthly, the dividing strip is inclined to the outflow passage, so that the sectional area of the inflow passage becomes large, and the flow resistance of air decreases, thereby effectively cooling the component chamber.

Thus, the component chamber is effectively cooled, so that it is possible to enhance freezing efficiency in the refrigerator according to the present invention, thereby decreasing power consumption.

It will be apparent to those skilled in the art that various modifications and variations can be made in the present invention. For example, the rib 70 may be provided at the corner of the component chamber 11 instead of being provided at the external corner in the bent portion of the ventilating passage 60. Also, the first passage 60*a* may penetrate the molding 20 instead of being provided by s the predetermined space between the upper side of the molding 20 and the lower side of the cabinet 10. Thus, it is intended that the present invention covers the modifications and variations of this invention provided they come within the scope of the appended claims and their equivalents.

What is claimed is:

1. A built-in refrigerator, comprising:

main body configured to be installed adjacent to a sink and having a component chamber at a rear lower side thereof;

a molding provided on a surface on which the refrigerator is disposed at a front bottom of the main body;

a compressor provided within the component chamber;

a cooling fan provided within the component chamber and configured to blow air to the compressor;

a condenser configured to condense a refrigerant flowing therethrough by heat-exchange with the air blown from the cooling fan; and a ventilating passage formed between a lower surface of the main body and a surface on which the main body is disposed and configured to allow external air from a front side of the main body into the component chamber and to discharge air from the component chamber to the front side of the main body.

2. The built-in refrigerator as claimed in claim 1, wherein the condenser is provided on a wall of the component chamber.

3. The built-in refrigerator as claimed in claim 2, wherein the condenser is partially buried in the wall, and is partially exposed for heat-exchange with the air blown from the cooling fan.

4. The built-in refrigerator as claimed in claim 1, wherein a plurality of holes are provided in one or more sidewalls of the component chamber.

5. The built-in refrigerator as claimed in claim 2, wherein a plurality of holes are provided in one or more sidewalls of the component chamber.

6. The built-in refrigerator as claimed in claim 1, wherein the ventilating passage, comprises:

a first passage comprising a predetermined space formed between an upper side of the molding and a lower side of the cabinet; and a second passage comprising a predetermined space formed between a lower side of the main body and a surface on which the refrigerator is disposed.

7. The built-in refrigerator as claimed in claim 1, wherein the main body further comprises a door at a front side thereof.

8. The built-in refrigerator as claimed in claim 7, wherein a lower side of the main body is configured such that a door side of the main body is higher than a component chamber side of the main body, to thereby form the ventilating passage having a bent portion.

9. The built-in refrigerator as claimed in claim 8, further comprising a rib having an air-guiding surface provided at an external corner in the bent portion of the ventilating passage, the air-guiding surface reducing flow resistance of air.

10. The built-in refrigerator as claimed in claim 9, wherein the rib comprises:

a first rib provided at a contact portion of an inner sidewall of the molding and a surface on which the refrigerator is disposed; and a second rib provided at a contact portion between a side of the main body facing an upper side of the molding and the bent portion of the main body facing the inner side of the molding.

11. The built-in refrigerator as claimed in claim 9, wherein the air-guiding surface is formed as a straight line extending at an inclined angle.

12. The built-in refrigerator as claimed in claim 9, wherein the air-guiding surface is formed as a bent line extending at an inclined angle.

13. The built-in refrigerator as claimed in claim 12, wherein the bent line of the air-guiding surface is concave.

14. The built-in refrigerator as claimed in claim 1, further comprising a dividing strip configured to divide the ventilating passage into an inflow passage through which the air is introduced and an outflow passage through which the air is discharged.

15. The built-in refrigerator as claimed in claim 14, wherein the dividing strip forms the inflow passage at a sucking side of the cooling fan, and forms the outflow passage at a discharging side of the cooling fan.

16. The built-in refrigerator as claimed in claim 14, wherein the dividing strip is inclined at a predetermined angle θ such that an inlet of the inflow passage is larger than an outlet of the inflow passage.

17. The built-in refrigerator as claimed in claim 16, wherein the dividing strip is inclined about 20°(θ) to an imaginary perpendicular line.

18.The built-in refrigerator as claimed in claim 16, wherein one end of the dividing strip located at the inlet side of the inflow passage is installed at a position corresponding to a center between the sucking and discharging sides of the cooling fan.

19. The built-in refrigerator as claimed in claim 1, wherein a rear wall and at least one sidewall of the component chamber have no holes therein.

20. The built-in refrigerator as claimed in claim 1, wherein the main body comprises a cabinet.

21. A built-in refrigerator, comprising:

a main body configured to be installed adjacent to a sink and having a component chamber at a rear lower side thereof;

a condenser and a compressor respectively installed in the component chamber;

a cooling fan installed in the component chamber and configured to cool the condenser and the compressor; and a ventilation passage configured to allow external air from a front side of the main body into the component chamber and to discharge air from the component chamber to the front side of the main body.

22. The built-in refrigerator as claimed in claim 21, wherein the molding is configured to be positioned on a surface on which the refrigerator is disposed between the door and a protruding portion of a lower side of the main body.

23. The built-in refrigerator as claimed in claim 22, wherein the lower side of the door is positioned at approximately the same height as an upper side of the molding.

* * * * *